US012280286B1

(12) United States Patent
Baran

(10) Patent No.: US 12,280,286 B1
(45) Date of Patent: Apr. 22, 2025

(54) UPRIGHT GLUTEUS EXERCISE MACHINE

(71) Applicant: John Baran, The Villages, FL (US)

(72) Inventor: John Baran, The Villages, FL (US)

( * ) Notice: Subject to any disclaimer, the term of this patent is extended or adjusted under 35 U.S.C. 154(b) by 0 days.

(21) Appl. No.: 18/764,308

(22) Filed: Jul. 4, 2024

(51) Int. Cl.

| | |
|---|---|
| ***A63B 21/065*** | (2006.01) |
| ***A63B 21/00*** | (2006.01) |
| ***A63B 21/06*** | (2006.01) |
| ***A63B 21/062*** | (2006.01) |
| ***A63B 23/02*** | (2006.01) |
| ***A63B 23/04*** | (2006.01) |

(52) U.S. Cl.
CPC ..... *A63B 21/065* (2013.01); *A63B 21/0615* (2013.01); *A63B 21/0626* (2015.10); *A63B 21/4005* (2015.10); *A63B 21/4007* (2015.10); *A63B 21/4009* (2015.10); *A63B 21/4035* (2015.10); *A63B 21/4049* (2015.10); *A63B 23/0233* (2013.01); *A63B 2023/0411* (2013.01); *A63B 2225/09* (2013.01)

(58) Field of Classification Search
CPC ..... A63B 21/065; A63B 21/0615; A63B 21/0626; A63B 21/4005; A63B 21/4007; A63B 21/4009; A63B 21/4035; A63B 21/4049; A63B 23/0233; A63B 2023/0411; A63B 2225/09
See application file for complete search history.

(56) References Cited

U.S. PATENT DOCUMENTS

| | | | | | |
|---|---|---|---|---|---|
| 5,050,868 | A * | 9/1991 | Pearson | A63B 21/0626 | 482/94 |
| 5,669,859 | A * | 9/1997 | Liggett | A63B 21/0626 | 482/94 |
| 6,623,409 | B1 * | 9/2003 | Abelbeck | A63B 21/0783 | 482/110 |
| 7,909,743 | B1 * | 3/2011 | Webber | A63B 21/078 | 482/94 |
| 8,500,608 | B1 * | 8/2013 | Bonomi | A63B 21/0626 | 482/101 |
| 9,011,298 | B2 * | 4/2015 | Bonomi | A63B 21/0609 | 482/101 |
| 9,067,102 | B2 * | 6/2015 | Poppinga | A63B 21/0783 | |
| D735,821 | S * | 8/2015 | Alenaddaf | D21/686 | |
| 9,526,938 | B2 * | 12/2016 | Chen | A63B 23/0405 | |
| D804,594 | S * | 12/2017 | Jones | D21/680 | |
| D898,137 | S * | 10/2020 | Carmichael | D21/686 | |
| 11,173,337 | B2 * | 11/2021 | Jones | A63B 21/0626 | |
| 11,235,192 | B1 * | 2/2022 | Thomas | A63B 21/078 | |
| D955,511 | S * | 6/2022 | Carmichael | D21/688 | |
| D980,354 | S * | 3/2023 | Gong | D21/673 | |
| 11,707,642 | B2 * | 7/2023 | Fourney | A63B 21/078 | 482/104 |
| 2006/0252609 | A1 * | 11/2006 | Abelbeck | A63B 21/0626 | 482/92 |
| 2006/0252615 | A1 * | 11/2006 | Melcer | A63B 23/0405 | 482/94 |
| 2008/0300116 | A1 * | 12/2008 | Eder | A63B 21/063 | 482/100 |
| 2023/0123978 | A1 * | 4/2023 | Carlson | A63B 21/08 | 482/94 |

* cited by examiner

*Primary Examiner* — Andrew S Lo

(74) *Attorney, Agent, or Firm* — Emmett S. Collazo

(57) ABSTRACT

The invention provides a cantilevered lower body apparatus for gymnasts and athletes comprised of a frame, bar, cantilevered and rotating arms, swivel attachments, and weights. The apparatus targets the lower back, gluteus maximus muscles, and hamstrings, and provides reduced risk of injury and more focused performance of exercises.

9 Claims, 9 Drawing Sheets

UPRIGHT GLUTEUS EXERCISE MACHINE

FIELD OF THE INVENTION

In the field of exercising and exercise equipment, a common problem in exercising for athletes is the need to eliminate risks, costs, and time required for an exercise referred to as the barbell hip thrust. The barbell hip thrust is a popular strength training exercise that targets the gluteal muscles (glutes), hamstrings, and lower back. It involves lifting a barbell using the hips, and while it can be an effective exercise, some individuals may experience issues or problems when performing it, and the exercise generally involves timely ad hoc set up, risks due to the lack of a spotter, and other problems.

Regarding a description of the difficulty and steps involved in a barbell hip thrust, a user will generally lie down with a barbell on the user's stomach or groin area to perform the exercise for the lower back, gluteus maximus, and hamstring muscles. The floor-based barbell hip thrust may be performed with elbows on a bench, some padding, and possibly a spotter. The user will often be leaning against padding or a bench and facing generally upwards towards the ceiling or sky. The barbell will pass across the user's body at the pelvis area and will extend left to right, roughly perpendicular to the user's body length. The weight will rest against the user in the area of the pelvis, and the user will press upwards by flexing gluteous, lower back, and hamstring muscles, pushing the weighted barbell in an upward vector. The move can be extremely challenging and potentially dangerous if not done with the correct form and safety precautions, and even with a spotter, the move is not well controlled. A spotter cannot stand or be positioned behind the user's back, as the user's back is to the groun), cannot stand or be positioned in front of or above the user's body because that is where the weight is travelling, and cannot stand or be positioned at the user's feet because that provides no degree of substantially utility during the exercise.

Potential problems associated with the barbell hip thrust include:

1. Improper Form. One of the most common problems with the barbell hip thrust is improper form. If the exercise is not performed correctly, it can lead to ineffective muscle engagement and, more importantly, an increased risk of injury. Poor form may include overarching the lower back, not fully extending the hips, or improper foot placement. Performing the exercise with the correct form is essential to target the intended muscle groups effectively and prevent injury. This includes keeping the core engaged, maintaining a straight line from shoulders to knees at the top, and avoiding excessive arching of the lower back.

2. Neck Discomfort. Some individuals may experience discomfort in the neck or upper back, especially if they are not using proper padding or if the bench or seat (if using the ground) is not positioned correctly. Placing a pad or towel on the barbell and ensuring it is centered across the hips can help alleviate this issue, but risks of injury still exist, and the movements with a weight generally create risk of dislodging the weight from a controlled area in relation to the athlete or user.

3. Hip Flexor Dominance. Maintaining balance and stability with the barbell on hips is demanding. Users need to ensure that the barbell stays in place throughout the movement, and any imbalance can lead to discomfort or injury. If not executed properly, the barbell hip thrust can lead to overactivity of the hip flexors, which may negate the intended benefits for the glutes. This can happen if the movement is initiated from the hips without proper engagement of the glute muscles.

4. Inadequate Warm-up. Like any exercise, performing the barbell hip thrust without a proper warm-up can increase the risk of injury. It's essential to prepare the muscles and joints with dynamic stretching and activation exercises before attempting heavy lifts.

5. Unstable Bench. Using an unstable bench or platform can compromise the stability of the exercise, leading to balance issues or potential accidents. It's crucial to use a sturdy bench or platform that can support the weight being lifted, and the weight being lifted generally requires ad hoc padding between the user and the weights, generally on some form of a barbell.

6. Inappropriate Resistance. The barbell adds a significant load to hips and lower back. The heavier the weight, the more challenging it becomes. It's crucial to start with a manageable weight and progressively increase it as strength improves. Using too much or too little weight can impact the effectiveness of the exercise. Too much weight may compromise form and increase the risk of injury, while too little weight may not provide sufficient resistance to stimulate muscle growth.

7. Not Progressing Gradually. Progression is key in strength training. Failing to progressively increase the load over time can result in a plateau in strength gains. However, progression should be gradual to avoid overexertion and reduce the risk of injury. The exercise heavily engages core muscles to stabilize the spine and pelvis. Weak core muscles can make this exercise particularly challenging.

8. Not Listening to Body Signals. Ignoring pain or discomfort during the exercise can be problematic. Pain may indicate poor form, an existing injury, or the need to modify the exercise. It's important to listen to the body and make necessary adjustments. Muscle fatigue can set in. As a user performs repetitions, lower back, gluteus maximus, and hamstring muscles may become fatigued, making it progressively more difficult to lift the weight.

A solution is needed to reduce the risk of or eliminate these problems.

BRIEF DESCRIPTION OF THE INVENTION

An object of the invention is to eliminate or reduce risks currently seen in an exercise known as the barbell hip thrust. Target audiences for embodiments of the invention would include general purpose athletes, sprinters that want to run more quickly, and those pursuing greater tone or muscle development in hamstrings, gluteus maximus, or lower back. The gluteus maximus and hamstrings are generally where the exercise is focused.

An athlete will frequently lie down with a barbell on the athlete's stomach to perform an exercise for the lower back, gluteus maximus, and hamstring muscles. This can be extremely challenging and potentially dangerous if not done with the correct form and safety precautions.

A cantilevered lower body apparatus with rest stops, a vertical bench, shoulder padding, a frame, and other controlled elements provide an effective and challenging workout for gymnasts and other athletes, helping them build strength in their lower back, gluteus maximus muscles, and hamstrings while maintaining proper form and safety. Embodiments of the invention are versatile for other exercises and allow for progression by adjusting the weight, making it suitable for athletes of varying fitness levels.

DETAILED DESCRIPTION OF THE INVENTION

Figure 1:
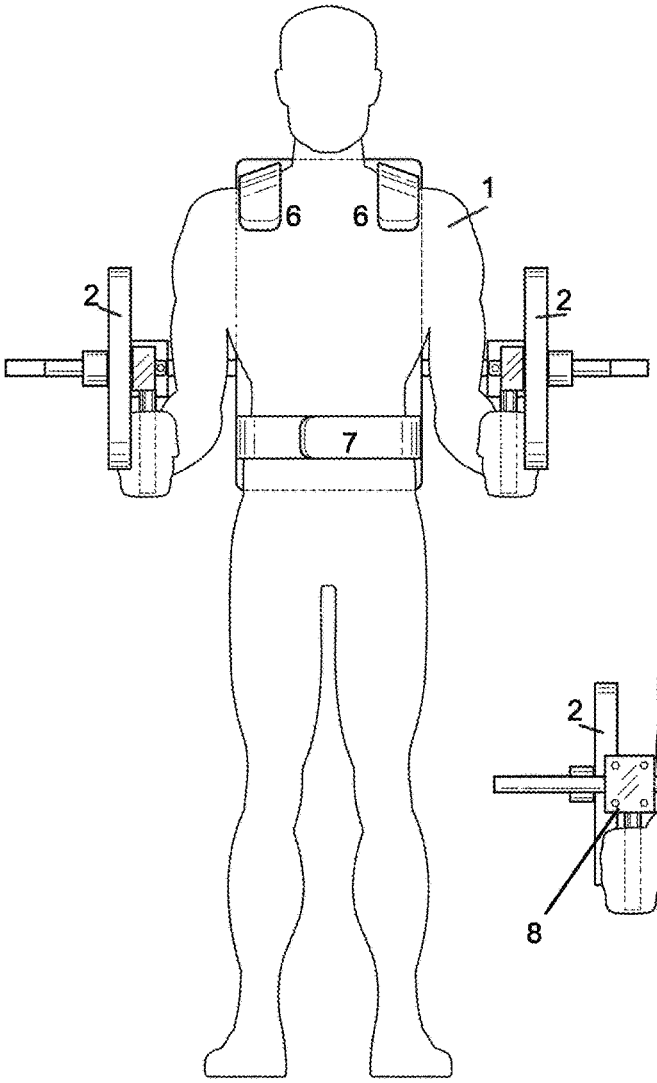
FIG. 1 is a front view of shoulder and belt support elements of the apparatus on a user.
Figure 2:
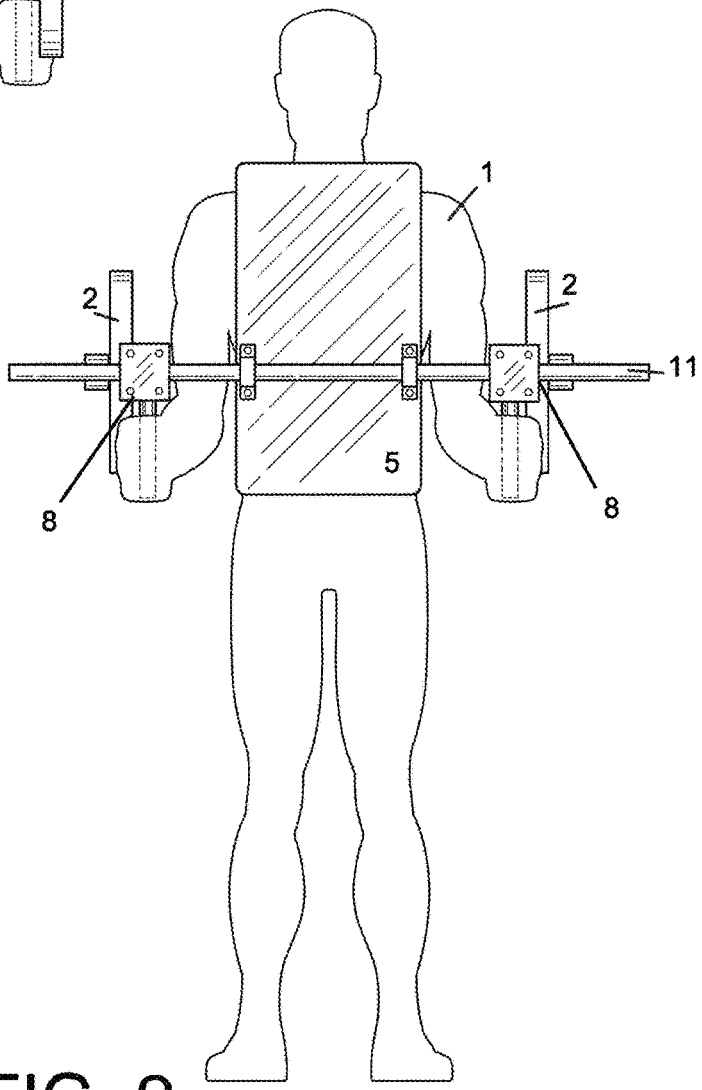
FIG. 2 is a rear view of shoulder and weight support elements of the apparatus on a user.

To use embodiments of the invention, a user 1 would step into the frame of the apparatus and stand up straight.

Embodiments may include a base and support frame 4, a back support 5, a brace 7, shoulder support 6, and attachment clamps and/or straps, for example a rotational barbell strap which is known in the art. The frame 4 of the gymnastics exercise machine is responsible for supporting the inner workings of the apparatus, including the moving parts and the components that allow the gymnast to perform the exercises safely.

Figure 12:
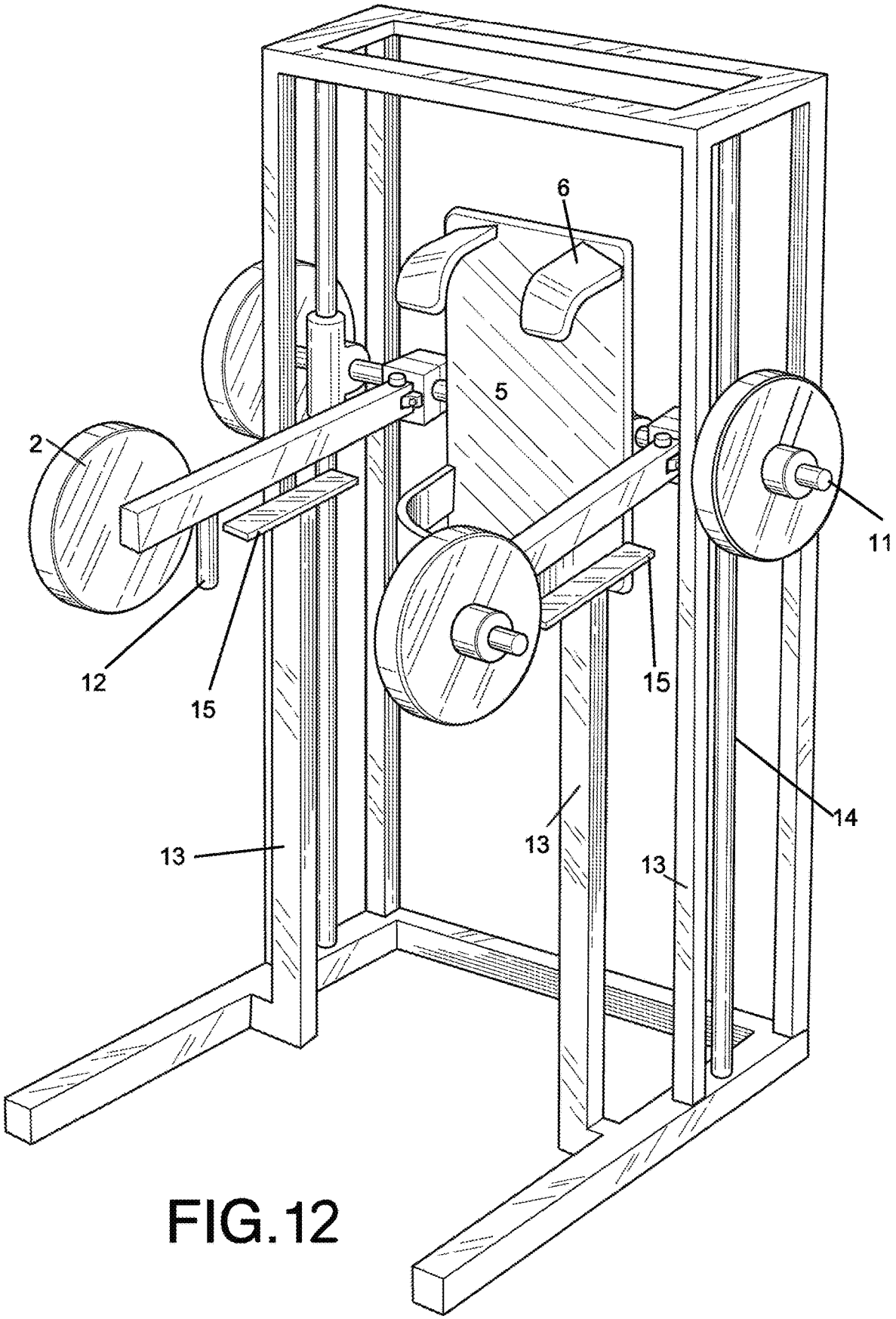
FIG. 12 is a ¾ view of an embodiment of the exercise apparatus.
Figure 13:
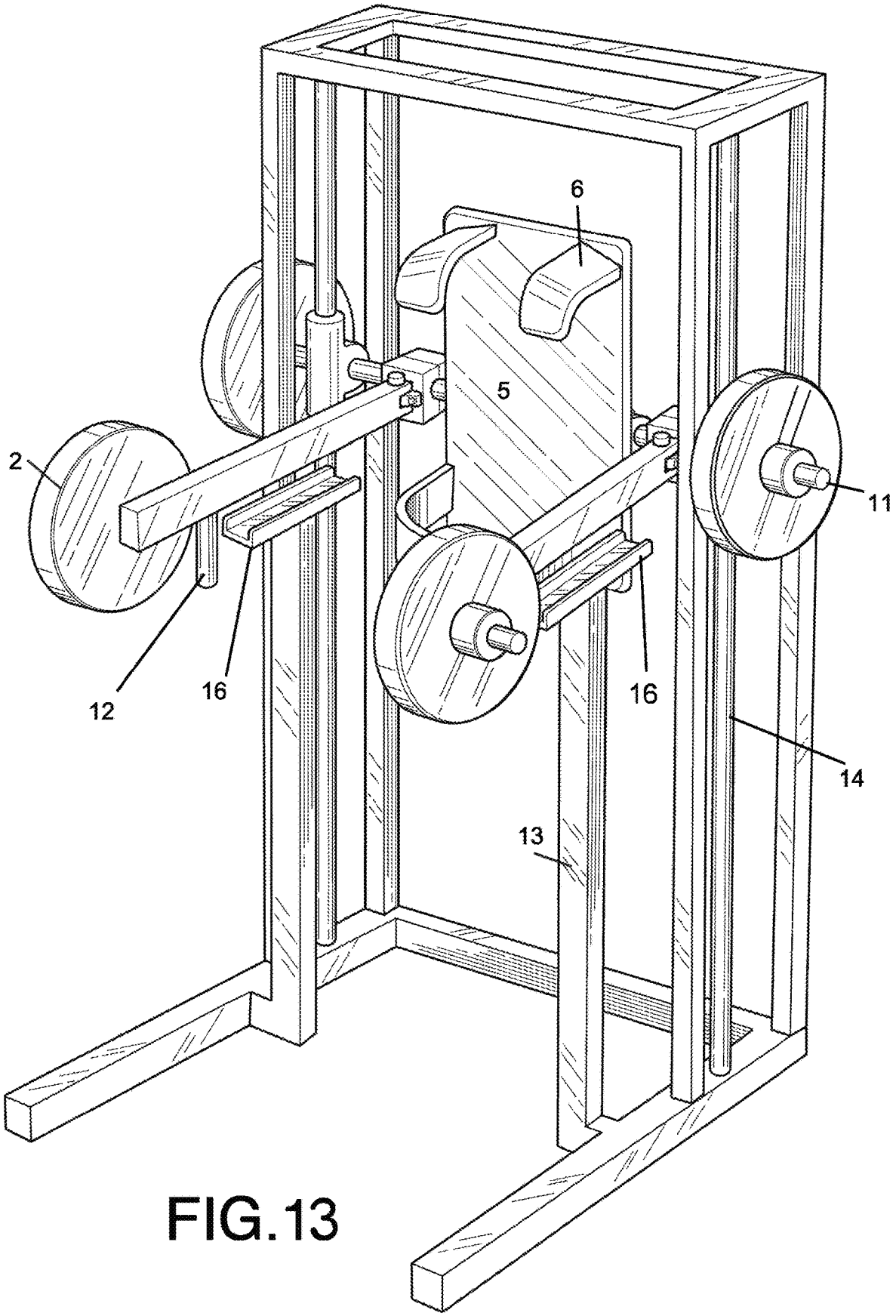
FIG. 13 is a ¾ view of an embodiment of the exercise apparatus.

Plates 2 are mounted on the end of arms 9 that lay on rest stops 13, rotates and slides upwardly as the person moves from a relatively crouched position (FIG. 4) to a standing position (FIG. 1, 2, 3). In alternative embodiments, arms 9 lay on rest stops 15 or 16 as shown in FIG. 12 or 13, where the rest stops may have gripping materials or other friction, as well as magnets or other means of securing the arms. As another example, the arms may rest within a channel as in 16 as shown in FIG. 13. These attributes and properties may be combined to create a further reduced risk of the arm falling below, or alternatively there may be a mechanical barrier along the arm 9 and upright slide 8.

A user 1 enters the machine, secures the belt 7 on the pelvic line or generally below the waistline. When the user 1 steps into and attaches belt 7, the forces from the belt 7 will create a pressure that encourages the user into a squat position or bent position. For the primary exercise in embodiments, the user 1 pushes against the belt 7, unlike typical squatting machines where the user lifts a bar in the vertical plane, generally above the shoulders, by flexing the quadriceps, primarily, among other muscles. For the revised barbell hip thrust, the goal is to replace the risk-prone, less-controlled barbell hip thrust that occurs on the ground or in a horizontal position, with a framework that allows the user 1 to make that motion but in a vertical harness with safety features and a shorter time for set up, among other benefits.

When the user 1 initially is secure in the machine, with the belt 7 secured, the user 1 will lift up the apparatus's arms 9 and bring the apparatus arms 9 towards the user 1. The user 1 then takes the semi-crouched, position, which for many users will be a 25% squat from the standing position, with the waist to the posterior and bring the waist to the anterior.

In embodiments, a properly controlled movement requires a user 1 to target the muscles of the glutes and the hamstrings. Instead of a bench, sturdy surface, or padding or mat for comfort, and rather than being positioned so that the upper back will be resting on the edge of a bench, the user 1 is upright in the frame 4.

With knees bent, feet flat on the ground, and the weight centered and comfortably placed along the back, shoulders, and arms, the user 1 grasps the apparatus grips 12 to raise the arms 9 to the proper position and off of any rest stops 13. User 1 feet should be shoulder-width apart.

The user 1 adjusts body so that the shoulders fall under the shoulder rests 6 and the back against the back bench 5. The user 1 initiates the movement by repositioning and receiving the weights of the plates 2 and arms 9 and bends knees to approximately a 90-degree angle as shown in FIG. 4.

The user 1 presses through heels, engaging the user's glutes and driving hips forward (as opposed to upward in the floor-based or horizontal-bench-based version of the exercise). The user 1 moves hips and pelvis forward until the body forms a straight line from your shoulders to your knees as shown in FIG. 3.

Figure 3:
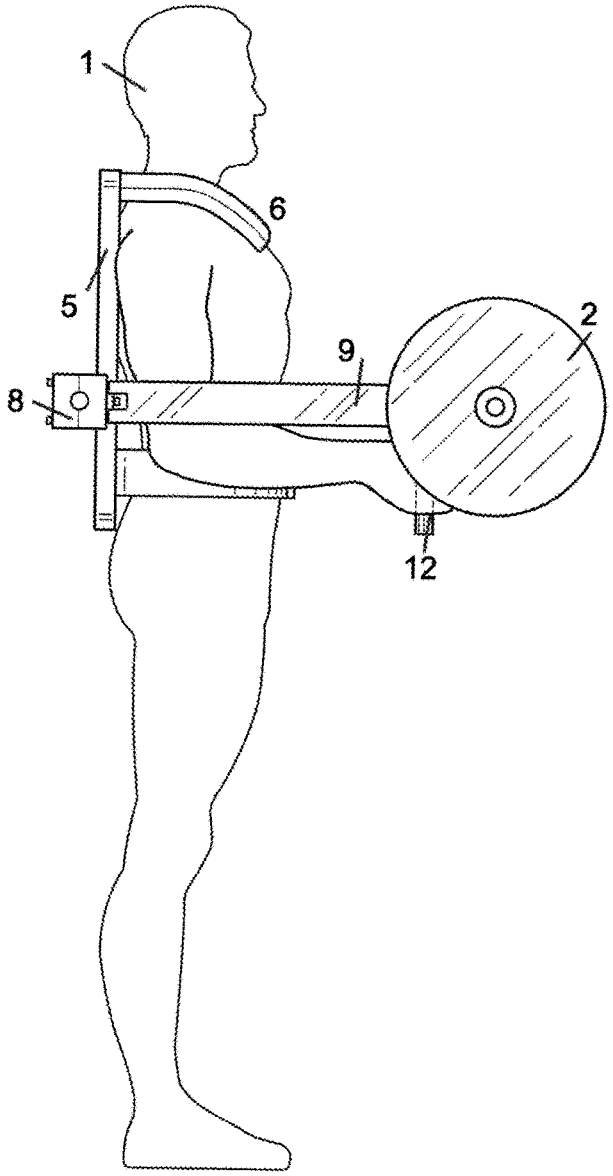
FIG. 3 is a side view of shoulder and weight support elements, with weight on an arm of the apparatus, when a user has completed the standing up motion.
Figure 4:
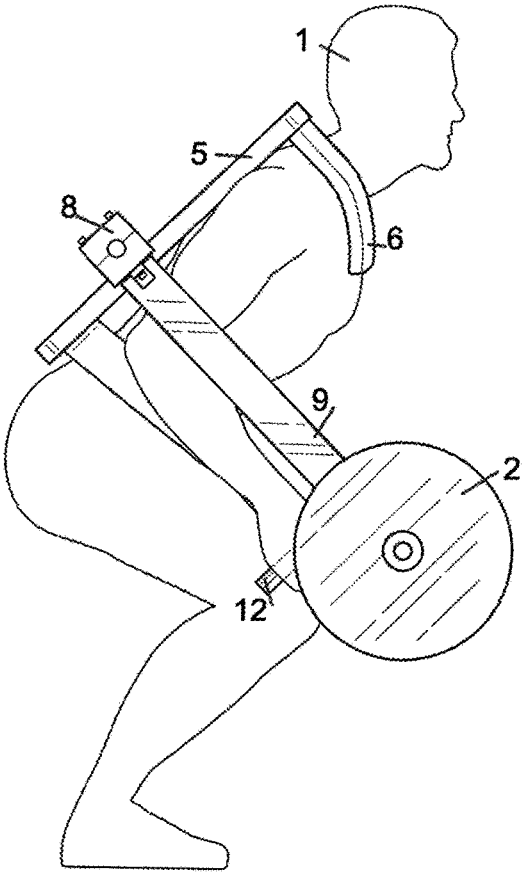
FIG. 4 is a side view of shoulder and weight support elements, with weight on an arm of the apparatus, when a user is about to apply force to lift the weight from a crouched position.

As the user 1 moves from FIG. 4 to FIG. 3, the movement requires a user 1 to squeeze glutes and hamstrings. This is the contraction point of the exercise. The arms will be on horizontal and parallel to the floor, the bench perpendicular to the floor.

The user 1 then repeats for the determined number of repetitions, again receiving the weight in a lowering phase, where the hips retreat rearwardly and the user 1 bends knees again to approximately 90 degrees in a controlled manner, keeping tension in the glutes throughout the descent. The user's 1 repetitions should be smooth and controlled motion throughout the exercise.

Generally, the user 1 will keep the chin tucked and maintain a neutral spine throughout the movement, ensure that the weight is distributed evenly through both feet, not overextend or bow at the bottom of the movement, and focus on hip contraction and extension. User 1 should generally start with a light weight to practice the movement and gradually increase the load as strength improves.

A successful exercise will target a user's 1 gluteus maximus (main target), hamstrings, and erector spinae (lower back muscles), among other muscles. As will be known to those with skill in the art, the barbell hip thrust is a valuable exercise for building strength and hypertrophy in the glutes, making it popular among athletes, bodybuilders, and fitness enthusiasts. As with any exercise, proper form is crucial to prevent injury and maximize effectiveness. Beginner users may want to start with bodyweight hip thrusts before progressing to using a barbell.

A spotter, if required, can be positioned to the rear or posterior of the user 1 to provide support, added control, guidance, or aid if needed. Two spotters, alternatively, can be located to the sides of the user, positioned to support the cantilevered arm weights or the user, or both.

When performing the motion, the user 1 will lift up the cantilevered weights, brings the weights in, place the weights before the user and away from any obstacles, and execute.

In embodiments, when the user completes a number of repetitions, the user may then lift up, place both arms 9 back on rest stops 13. The user may then repeat the exercise steps.

After taking the arms off, for example, 30 degree rest stops 13, the force of the cantilevered weight 2 at the end of arm 9 and against the user 1 and belt 7 carries forces like a floor barbell hip thrust.

Where the arms 9 are secure, the user lifts up to release the arms from the stops, gets the two cantilevered arms off of and free from the rest stops, and now the arms and plates are generally in front of the user.

To begin the motion, with the user's back to back support 5, the user lifts the arms 9 of the apparatus off of rest stops 13. From this start position, which is the same position as the finish position (FIG. 1, 2, 3), the weight (e.g., plates 2) will have reached generally their acme above the ground. When a user wants to perform the exercise, the user will crouch, often no more than 25% to 50%, and then lift upwardly against the force of gravity.

Embodiments may include upright slides 8 that allow the rotating bar 11 to move in a vertical plane as well as rotate about the bar's axis. While embodiments include arms creating a cantilevered weighted squat trainer, two sturdy upright slides 8 that are securely anchored to the ground, providing stability and guiding the movement of the rotating bar 11 up and down. The effect is to create with the weighted arms a torque effect for the user to manage. Like a typical squatting weight apparatus, knees are typically bent, and the user lowers their body by flexing at the hips and knees. Unlike a typical squatting apparatus, the user's 1 body folds with the waist moving rearwardly as the exercise is performed, and while the typical squatting machine engages the quadriceps, possibly primarily, the instant invention focuses on the glutes, the hamstrings, and lower back, which all must be engaged to control the cantilevered weights and their torque forces on the user's muscles.

Embodiments may include a rotating round bar 11 where the fully rotating round bar extends horizontally between the two upright slides 8. This bar is designed to rotate freely, allowing for a wide range of motion during the exercise.

Figure 6A:
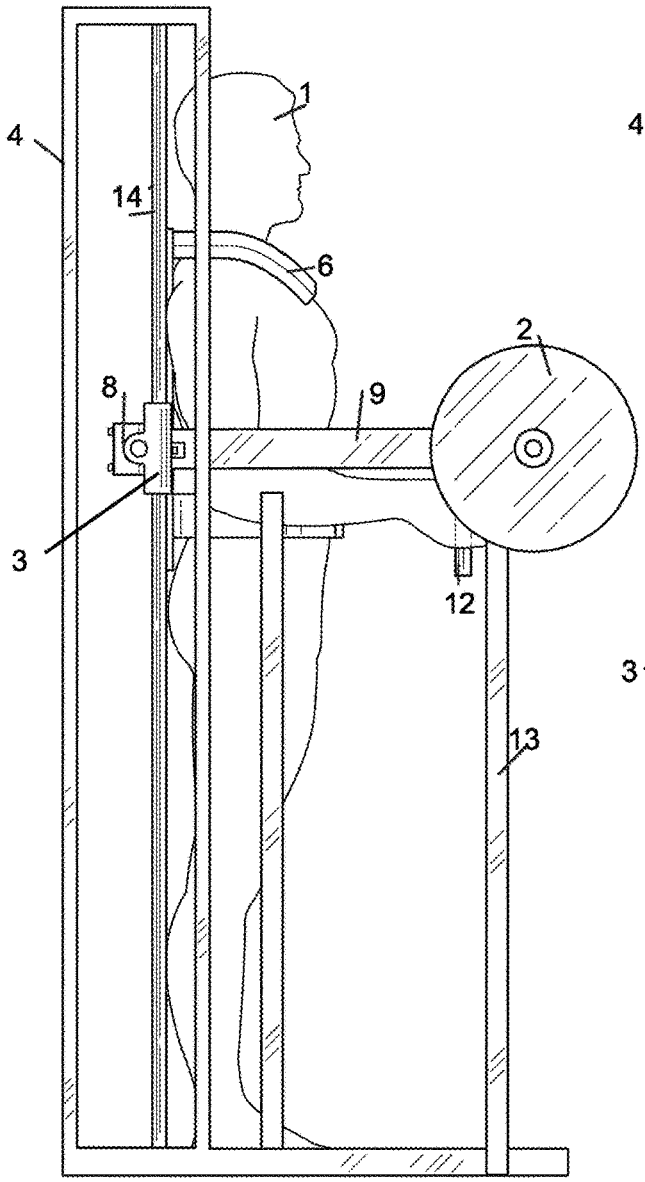
FIG. 6A is a side view of a user standing upright in an embodiment of the apparatus where the user is standing.
Figure 6B:
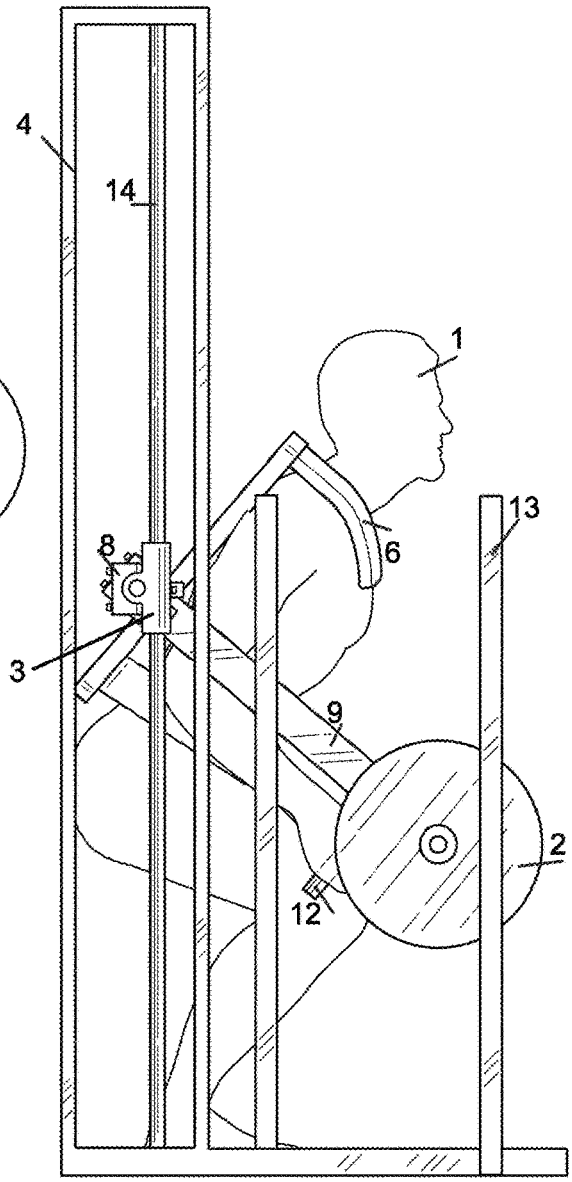
FIG. 6B is a side view of a user standing upright in an embodiment of the apparatus where the user is crouching.
Figure 7:
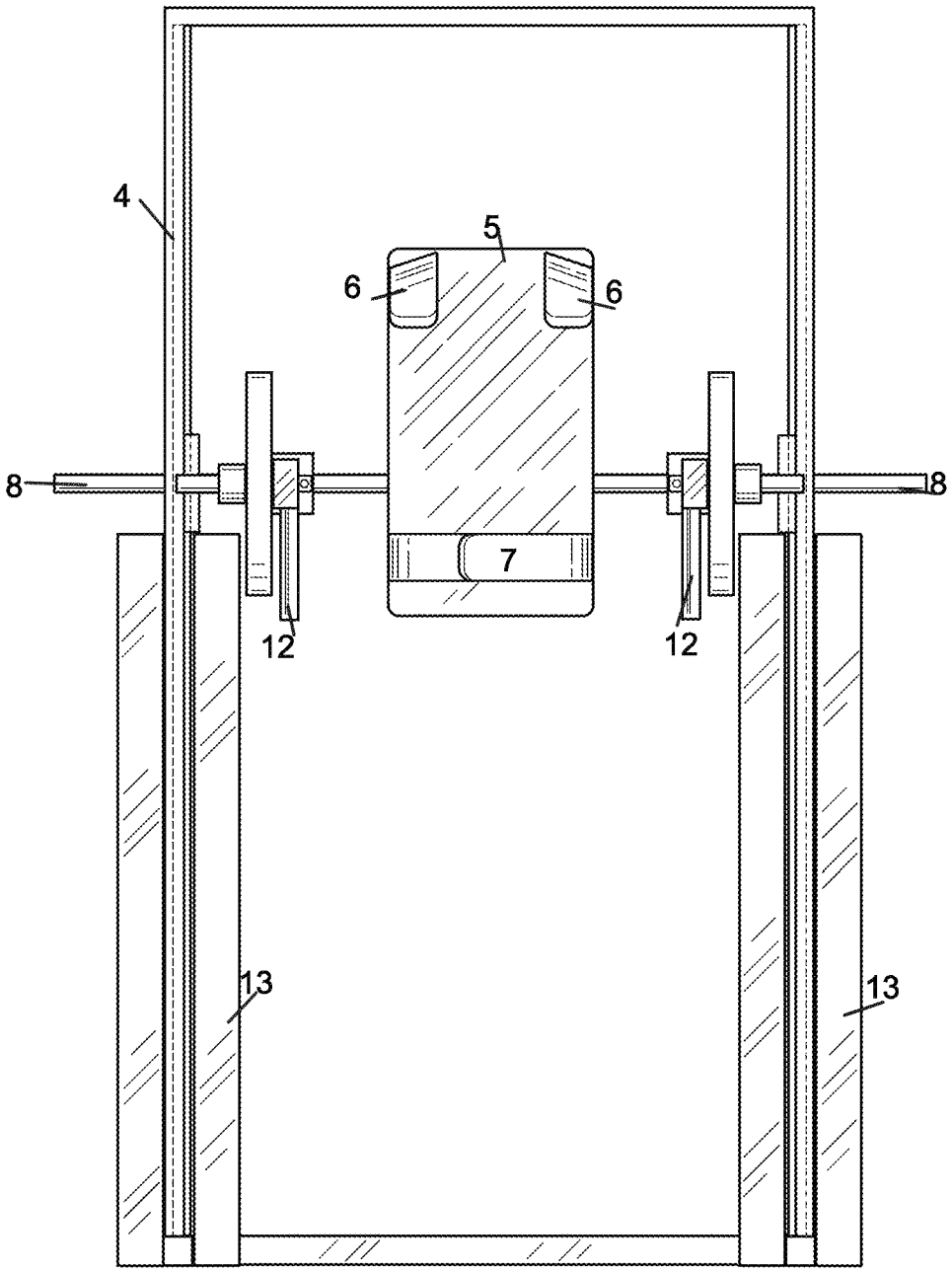
FIG. 7 is a front view of the apparatus, including weights, shoulder and belt supports, and a parallel bar that will rotate during the exercise.
Figure 8:
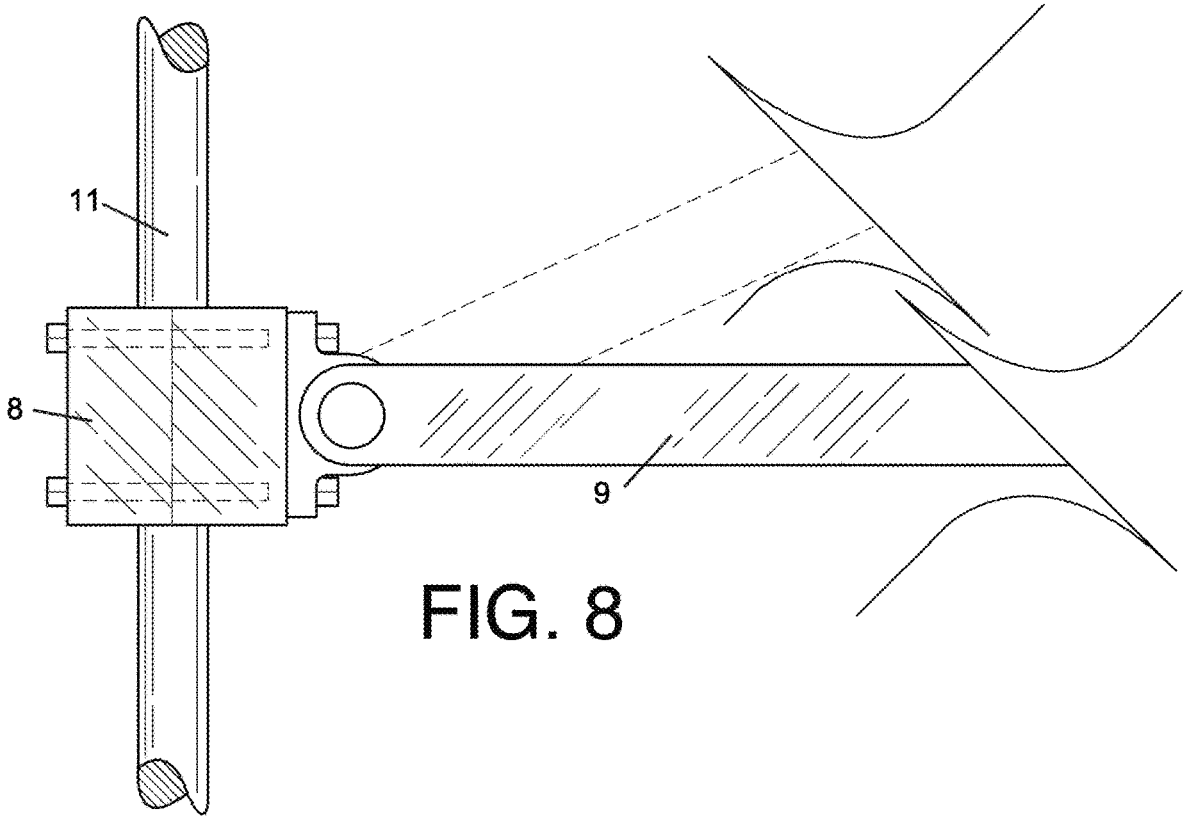
FIG. 8 is a top-down view of the connection between the stable elements of the exercise apparatus and the movable bar that bears weights.
Figure 9:
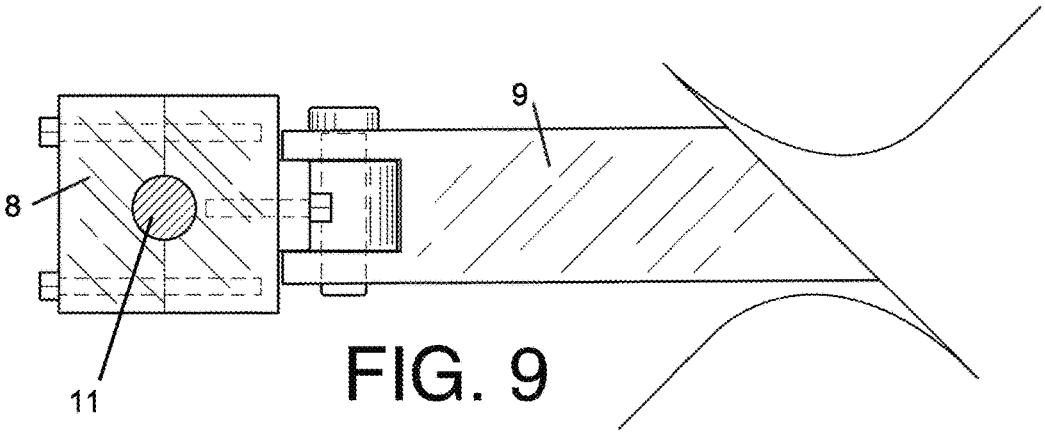
FIG. 9 is a side view of the connection between the stable elements of the exercise apparatus and the movable bar that bears weights.
Figure 10:
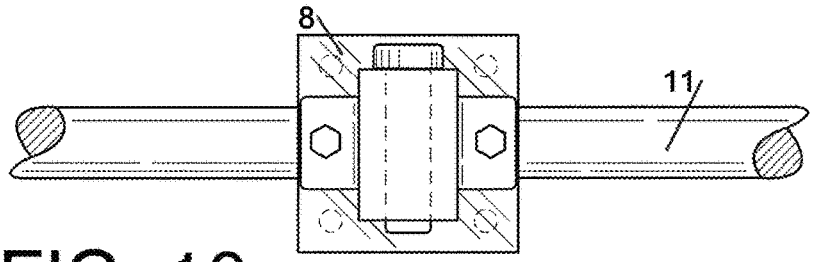
FIG. 10 is a frontal view of the connection between the stable elements of the exercise apparatus and the movable bar that bears weights, where the handle is removed.

Embodiments may include back support 5 positioned on the rotating bar 11, for example as a comfortable back support 5 with two padded shoulder rests 6. These shoulder rests 6 offer support to the user's 1 upper body, helping them maintain proper posture during the exercise. See FIG. 6.

Figure 11:
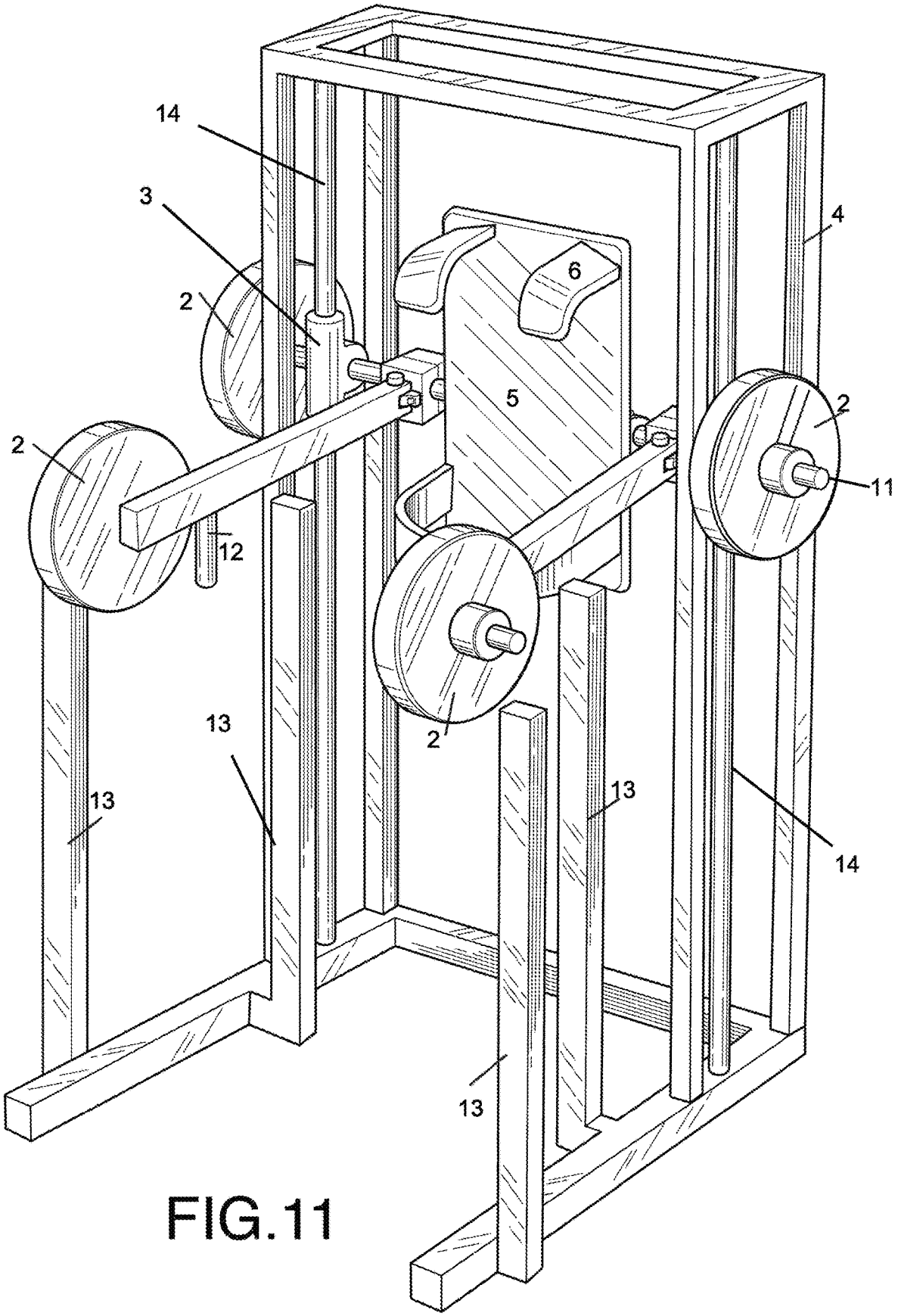
FIG. 11 is a ¾ view of an embodiment of the exercise apparatus.

As shown in FIG. 11, embodiments may include a sliding device 3 to follow, for example, the vertical plane of the frame while the bar 11 while the user 1 uses the apparatus, receiving forces on the exercised areas as described above.

Embodiments may include a waist belt or brace 7. The back support 5 is equipped with a waist belt 7 that can be securely buckled around the user's 1 waist. This belt 7 ensures that the user 1 remains in a fixed position while performing the exercise.

Embodiments may include weight plates arms 9. On the rotating bar 11, two arms 9 are bolted in place, extending outward. These arms 9 have provisions for attaching standard weight plates 2 of various poundages. The user 1 can adjust the weight 9 according to their fitness level and preferences.

Embodiments may include cantilevered weights. The primary purpose of the weight plates arms 9 is to hold the cantilevered weight. When the user lifts up a few inches, the cantilevered weight extends out in front of them, creating a force that works the lower back, gluteus maximus muscles, and hamstrings during a squat motion.

Embodiments may include rest stops. The rest stops allow the apparatus to be in a safe upright position so that the gymnast can enter and exit freely and safely with minimal effort.

Embodiments may include handles 12 that allow the user 1 to hold on to the machine for added balance and to move the weights 2 off the rest stop so that they can perform the exercise. See FIG. 5 for range of motion to get weights on and off the rest stops.

Performing the exercises with embodiments occurs as follows. The user 1 buckles themselves into the waist belt 7, then lift the bar 9 slightly to take the weight off the rest stops. See FIGS. 3 and 4 (shown without frame). With the cantilevered weight 2 in front of the user, the user can perform controlled squats, feeling the resistance and focusing on the lower back, gluteus maximus, and hamstrings.

Repetition and Rest. After completing a certain number of repetitions, the user 1 can move the two arms back out, allowing the cantilevered weight to return to its original position. They can then lower the bar 9 onto the rest stops 13, exiting the machine safely.

The torque of the cantilevered weight design works different muscles than a normal squatting machine, almost as if holding a dumbbell in front of the user and doing a squat. The frame 4 around the machine makes the movement more secure for the user 1, as the user has better control over posture. The user 1 starts squatting immediately. The bar 11 goes up and down and rotates.

This system avoids laborious setup. Currently, a user would have to take the barbell, put it on the ground, put the weights on the ends, set up the padding above and below the user, and likely request a spotter in an awkward position. The bar 11 alone could injure a person with its weight. Once completed with the exercising, the user would have to tear all of the elements down. A need exists for a more efficient use of an athlete's time.

Figure 5:
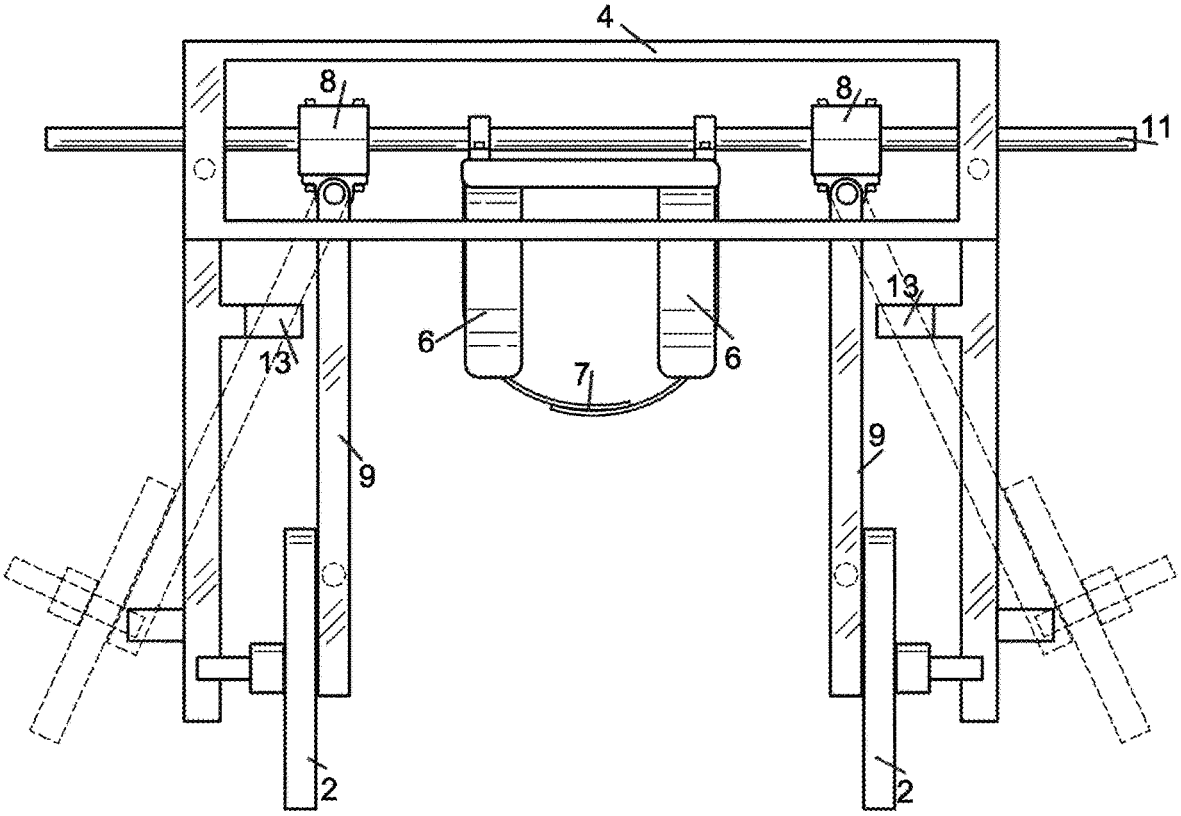
FIG. 5 is a view of the overhead elements of the apparatus with illustrated optional lateral movement of bars that may bear weights.

In an embodiment where the rest stops are adjustable, a telescoping pole 14 exists for height control, and the rotating bar will have lockable mechanisms that allow the bar to be placed at an appropriate height for different users. The mechanisms for pre-positioning a rotating bar 11 are well known in the art. An alternative embodiment for a telescoping pole 14 acting as an arm rest is to place several poles next to one another at different angles, for example at 20, 25, 30, and/or 35 degrees laterally, as shown by phantom lines in FIG. 5, from perpendicular arm rest position 9 as shown in FIG. 5. Optionally, several telescoping poles 14 may be located adjacent to one another at sufficient lateral angles, for example creating three rest stops where the arms are cleared of weights. The arms will be easier to pre-position before placing weighted plates on the arms.

Most embodiments will requires a solid, low-friction base for the user's feet. A rough mat, well known at most public and private gyms, will be sufficient to keep a user's feet on solid ground despite the torque forces of the cantilevered weights through the exercise motion. The backward force due to the torque requires a stable floor. Additional options includes a bar or feet placement with a low barrier or a bar for a user to put the user's heels against, prevent the user from feet moving backward.

Embodiments may also include frameworks where (1) the rest stops are adjustable in height or lateral location, (2) there are multiple rest stops, (3) the framework that carries the rotating barbell vertically is angled forward, with the top of the framework more to the anterior, and the base of the framework to posterior while performing the vertical barbell hip thrust, and (4) an embodiment where the arms are rotatable or reverse-extendable to the rear side and optional padding for receiving the chest of a user for exercises that work the legs, quadricep exercises and abdominal muscles while the user leans back and crouches.

Another application of the cantilevered weight system would have the user facing to the rear of the machine, and the grips and frame arms 9 would be to the rear of the preferred embodiment. Once the user steps into the machine facing the back board 5, the user would have to place the arms to the rear of the machine and could do a sit-up or abdominal workout.

An alternative embodiment would rotate or slide the arms 9 towards the rear of the back support 5 so the user can place the chest to back support 5, and leaning into that support 5, execute a reverse or negative of the barbell hip thrust exercise. This user would place arms on the opposite side of the support 5, where the weights may still be on the arm but either (1) behind the user, (2) to the side of the user, or (3) in front of the user at the end of the arms 9, which have been slid or positioned rearward of the primary embodiment location.

To place the arms to the rear of the preferred embodiment, the arms could slide back and forth, with two sets of handles, putting the weights on the opposite side of the bench from the user. This machine could now focus the user on sit-up and squat muscle groups. This would put tension on muscles that generally are not imposed simultaneously on a user.

Another embodiment of the invention would include extending the roll bar and placing weighted plates or other weight means on the lateral sides of the rolling bar. In this manner, the embodiment can support use as a squat exercise machine as well, providing opportunity to exercise the quadriceps in addition to the other leg (hamstring, primarily), abdominal, and back muscles.

In another embodiment, a user could disconnect the arms 9 from the rotating bar 11 to choose to do only a squatting exercise, after placing weights on the rotating bar 11.

In another embodiment, the apparatus will include an ergonomic handle 12. A patented handle design that enhances comfort, grip, and safety during the exercise. This could involve features such as contoured handles, grip materials, or innovative locking mechanisms to ensure a secure hold during the exercise routine.

The present invention has been disclosed with preferred embodiments as above. However, the disclosed embodiments are not used to limit the present invention. The skilled in the art could make slight changes and modification without departing from the spirit and scope of the present invention, and the changes and modification made thereto are all covered by the scope of the present invention.

The invention claimed is:

1. An exercise apparatus comprising:

a base and support frame, a rotating bar, at least two arms configured to receive weights, wherein each arm comprises at least one rest stop, a handle coupled at one end of each arm and configured to allow a user to hold on to the arm for added balance and to control movement of the arms off of a rest stop so that the user can perform an exercise, wherein the rotating bar is configured to rotate during an exercise motion, and a back support component connected to the rotating bar.

2. The apparatus of claim 1, wherein the rotating bar is cylindrical and extends horizontally between two upright slides.

3. The apparatus of claim 1, further comprising at least one upright slide securely anchored to the frame to provide stability and guide the movement of the rotating bar.

4. The apparatus of claim 1, wherein the back support component comprises two padded shoulder rests configured to support to the user's upper body for maintaining proper posture, the apparatus further comprising a sliding device that maintains the bar in a vertical plane within the frame.

5. The apparatus of claim 1, further comprising a waist belt that is configured to be buckled around the user's waist to support the user maintaining a controlled exercise position during exercises.

6. The apparatus of claim 1, wherein the arms are connected to the rotating bar and extend outward, and wherein the arms are configured to receive standard weight plates of various weights for user adjustment options.

7. The apparatus of claim 1, wherein the arms hold cantilevered weights, wherein each of the cantilevered weights extends in front of the user, creating a force that works the lower back, gluteus maximus muscles, and hamstrings during a squat motion.

8. The apparatus of claim 1, wherein the rest stops comprise telescoping poles disposed at different angles to a rear plane of the frame.

9. The apparatus of claim 1, wherein the rest stops comprise handles.

* * * * *